US007175117B2

(12) United States Patent
Naito

(10) Patent No.: US 7,175,117 B2
(45) Date of Patent: Feb. 13, 2007

(54) SUBSTANCE-ATOMIZING APPARATUS

(75) Inventor: Tomihisa Naito, Kanagawa (JP)

(73) Assignees: Syouko Naito, Kanagawa (JP); Tokai Corporation, Tokyo (JP)

( * ) Notice: Subject to any disclaimer, the term of this patent is extended or adjusted under 35 U.S.C. 154(b) by 0 days.

(21) Appl. No.: 10/528,202

(22) PCT Filed: Sep. 18, 2003

(86) PCT No.: PCT/JP03/11893

§ 371 (c)(1),
(2), (4) Date: Dec. 19, 2005

(87) PCT Pub. No.: WO2004/026481

PCT Pub. Date: Apr. 1, 2004

(65) Prior Publication Data

US 2006/0131451 A1 Jun. 22, 2006

(30) Foreign Application Priority Data

Sep. 18, 2002 (JP) ..... 2002-272049

(51) Int. Cl.
*B02B 1/00* (2006.01)

(52) U.S. Cl. ..... 241/39

(58) Field of Classification Search ..... 241/38, 241/39, 40, 185.6, 47, 270, 271, 262
See application file for complete search history.

(56) References Cited

U.S. PATENT DOCUMENTS 5,465,913 A * 11/1995 Naito ..... 241/39
5,984,519 A 11/1999 Onodera et al.
6,045,068 A 4/2000 Ashbrook
6,318,649 B1 11/2001 Mazurkiewicz
6,824,086 B1 * 11/2004 Mazurkiewicz et al. ..... 241/5

FOREIGN PATENT DOCUMENTS

JP 2001-271762 10/2001

* cited by examiner

*Primary Examiner*—Faye Francis
(74) *Attorney, Agent, or Firm*—Heller Ehrman LLP

(57) ABSTRACT

A substance-atomizing apparatus (30) has a pump member (9) and a generator member (12). The pump member (9) has a piston (13) that is reciprocally moved in a cylinder (17) by drive device (1) and pressurizes a raw material fluid. The generator member (12) makes the raw material fluid pressurized in the pump member (9) pass through a hole portion (26) provided inside the generator member, and atomizes a substance included in the raw material fluid in accordance with nozzle characteristics of the hole portion (26). A pressure chamber (14) is formed between the piston (13) and a closed end of the cylinder (17). An intake (15) is formed on a cylinder (17) side surface of the pressure chamber (14). An outlet (16) is formed on the closed end (18) of the cylinder (17). In the first half of a discharge stroke, the raw material fluid is sent from the pressure chamber (14) into a charge vessel (10) through the intake (15). In the last half of the discharge stroke, the intake (15) is directly closed by the side surface of the piston (13), and the raw material fluid is sent from the pressure chamber (14) into the generator member (12) through the outlet (16).

11 Claims, 6 Drawing Sheets

SUBSTANCE-ATOMIZING APPARATUS

TECHNICAL FIELD

The present invention relates to an apparatus for atomizing a substance treated in a food industry, a chemical industry or a medical industry etc., more specifically relates to an apparatus for atomizing a substance included in a raw material fluid by means of a pressurizer (such as a pump) which applies high pressure to the raw material fluid.

BACKGROUND ART

A three-tiered plunger pump is conventionally known as a pressurizer (such as a pump) which applies high pressure to a fluid (see Japanese Patent Provisional Publication No. 2001-271762). A substance included in a raw material fluid is atomized by charge-pressurizing the raw material fluid and then discharging it into a generator (or a nanomizer) by means of the plunger pump.

The plunger pump has three plungers each connected through a connecting-rod to a crankshaft which is rotatably supported to a crankcase. The plunger pump applies pressure on the raw material fluid inside a pressure chamber by reciprocally moving each plunger with rotation of the crankshaft. More specifically, when each plunger disposed on one end of the pressure chamber reciprocally moves, the raw material fluid is charged from a charge vessel into the pressure chamber through a check valve for charge which is disposed on a lower portion of the other end of the pressure chamber, or the pressured raw material fluid is discharged from the pressure chamber into the generator through a check valve for discharge which is disposed on a upper portion of the other end of the pressure chamber. Under this mechanism, the substance included in the raw material fluid is atomized to a desired particle size according to a nozzle character mounted inside the generator because high pressure (about 150 M Pa) is applied to the raw material fluid.

In a case where the raw material is changed, flushing out members of the plunger pump which contact with the raw material fluid prevents contamination, and thereby a substance included in a post-raw material fluid is not mixed with a substance included in a prior-raw material fluid. However, it takes a lot of work to flush out the members because the conventional pressurizer has many members.

Further, the check valve for charge has some problems in dependence upon a raw material fluid's character. The check valve has a valve seat, a valve body and a coil spring. The valve seat is disposed between the charge vessel and the pressure chamber. The valve body is formed of a metal sphere. One end and the other end of the coil spring are connected to the valve body and an interior of the check valve, respectively. The coil spring presses the valve body against the valve seat and then prevents the raw material fluid from flowing back from the pressure chamber into the charge vessel at the time of a pressure operation of the plunger pump.

In the check valve for charge taking such a configuration, the following three problems arise in dependence upon the raw material fluid' character. Firstly, if the raw material fluid's viscosity is high, the raw material fluid blocks the check valve. Therefore, it is necessary to mount a pressure feed pump into the charge vessel and forcibly push the raw material fluid out of the check valve. Secondly, if a particle size of a substance included in the raw material fluid is large, the substance always creates a space between the valve body and the valve seat. Therefore, the raw material fluid flows back at the time of a pressure operation of the plunger pump. Thirdly, if there is a different specific gravity among substances included in the raw material fluid, a substance having a high specific gravity is deposited at the bottom of the charge vessel. Therefore, it is necessary to equalize distribution of the substances inside the charge vessel by means of an agitator.

The present invention is proposed in view of actual conditions. An object of the present invention is to provide an atomizing apparatus incorporating a pump therein for allowing a raw material fluid to flow back from a pressure chamber into a charge vessel in the first half of a discharge stroke and preventing the raw material fluid from flowing back from the pressure chamber into the charge vessel in the last half of the discharge stroke, and giving an easy flushing work.

DISCLOSURE OF THE INVENTION

The present invention provides a substance-atomizing apparatus comprising: a pump member having: a cylinder opening at one end thereof and closing at the other end thereof; a pipe through which a raw material fluid is introduced from a charge vessel into the cylinder; and a piston reciprocally moved by a drive device in the cylinder to pressurize the raw material fluid in the cylinder; and a generator member inserting the raw material fluid pressurized in the pump member into a hole portion formed therein to atomize a substance included in the raw material fluid according to a nozzle character of the hole portion, wherein a pressure chamber is formed between the piston and a closed end of the cylinder, an intake to which the pipe opens at one end thereof is formed on a cylinder side surface of the pressure chamber, an outlet is formed on the closed end of the cylinder, the outlet is closed and the raw material fluid is received from the charge vessel into the pressure chamber through the intake in a first stroke of the piston, the raw material fluid is sent from the pressure chamber into the charge vessel through the intake in the first half of a second stroke of the piston, the intake is directly closed by a side surface of the piston and the raw material fluid is sent from the pressure chamber into the generator member through the outlet in the last half of the second stroke of the piston.

According to this invention, since, in the first half of the second stroke, the raw material fluid flows back from the pressure chamber into the charge vessel so that several raw materials among which specific gravity differs are agitated in the charge vessel, it is not necessary to install an agitator in the charge vessel. Further, since, in the last half of the second stroke, the intake is directly closed by the side surface of the piston, this certainly prevents the raw material fluid in the pressure chamber from flowing back into the charge vessel without depending on a character of the raw material fluid. Additionally, it is easy to flush out the apparatus because constructional elements are reduced.

BEST MODE FOR CARRYING OUT THE INVENTION

An embodiment of the present invention is described with reference to FIG. 1 to 3.

Figure 1:
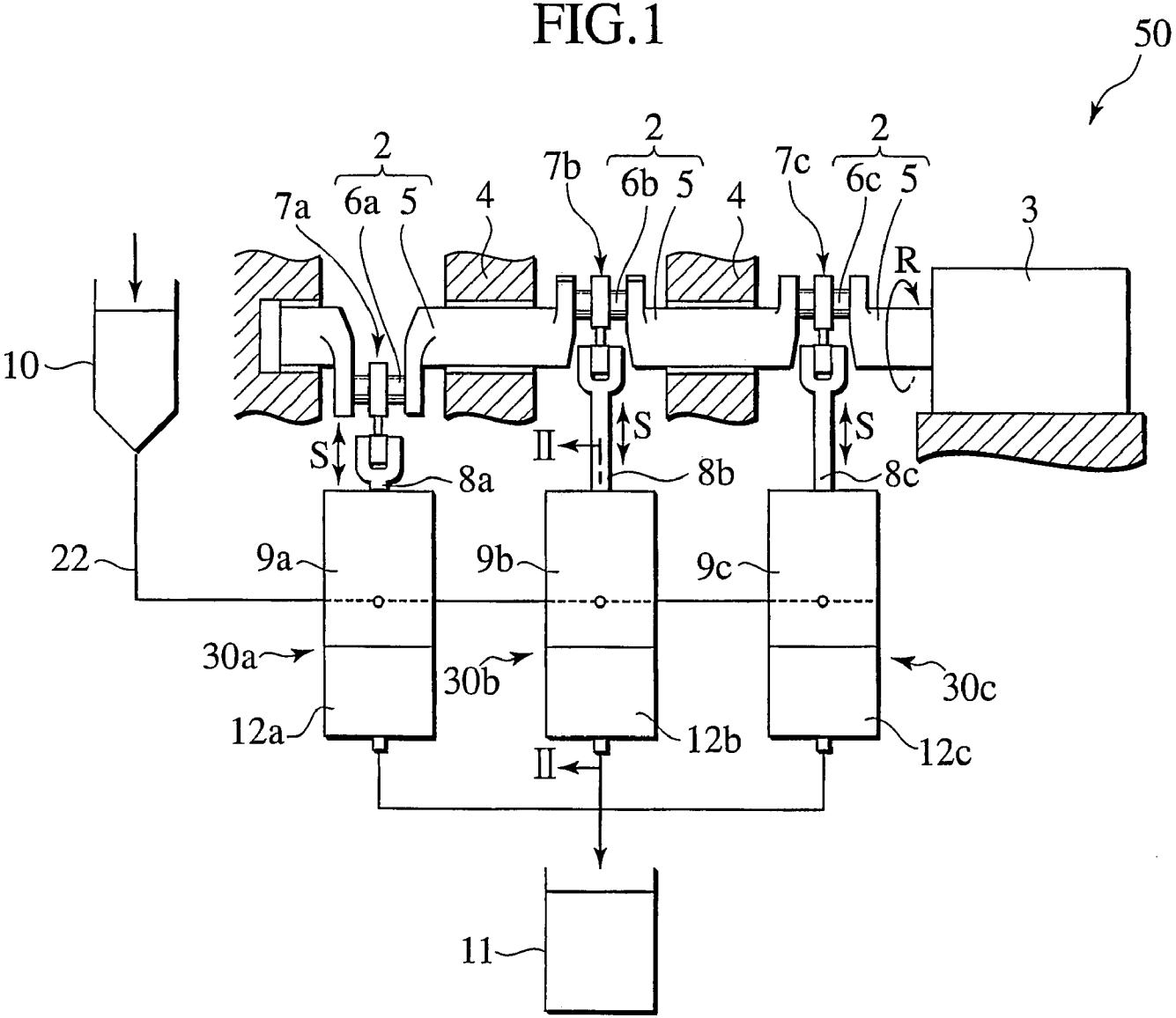
FIG. 1 is a block diagram of an atomizing process system which includes an atomizing apparatus incorporating a pump member of the present invention.

As shown in FIG. 1, an atomizing process system 50 comprises a drive device 1, a charge vessel 10, a discharge vessel 11 and atomizing apparatuses 30*a*, 30*b*, 30*c*.

The drive device 1 comprises a crankshaft 2 and a motor 3. The crankshaft 2 has a crank portion 5 rotatably supported to a crankcase bearing 4 and crankpins 6*a*, 6*b*, 6*c* disposed every 120° apart from each other in a rotate direction. The motor 3 rotates the crankshaft 2.

The crankshaft 2 is linked to piston yoke shafts 8*a*, 8*b*, 8*c* through connecting-rods 7*a*, 7*b*, 7*c* respectively connected to the crankpins 6*a*, 6*b*, 6*c*.

When the crankshaft 2 rotates in a direction of an arrow R, the piston shafts 8*a*, 8*b*, 8*c* reciprocally moves in a direction of an arrow S by swing movement of the connecting-rods 7*a*, 7*b*, 7*c*. Pistons 13 to be hereinafter described (see FIGS. 2 and 3) are integrally connected to lower ends of the piston shafts 8*a*, 8*b*, 8*c*, respectively.

The atomizing apparatuses 30*a*, 30*b*, 30*c* comprises pump members (processors) 9*a*, 9*b*, 9*c* and generator members (nanomizers) 12*a*, 12*b*, 12*c*. The pump members 9*a*, 9*b*, 9*c* are integrally connected to the generator members 12*a*, 12*b*, 12*c*. The charge vessel 10 for charging a raw material fluid into the atomizing apparatuses 30*a*, 30*b*, 30*c* is communicated with the pump members 9*a*, 9*b*, 9*c* through a pipe 22. The discharge vessel 11 for discharging an atomized raw material product (a sample) is communicated with the generator members 12*a*, 12*b*, 12*c*.

Next, a configuration of the atomizing apparatus 30 will be described in detail. Firstly, a configuration of the pump member 9 will be described and secondly, a configuration of the generator member 12 will be described. Here, it noted that the atomizing apparatuses 30*a*, 30*b*, 30*c* take the same configuration each other.

Figure 2:
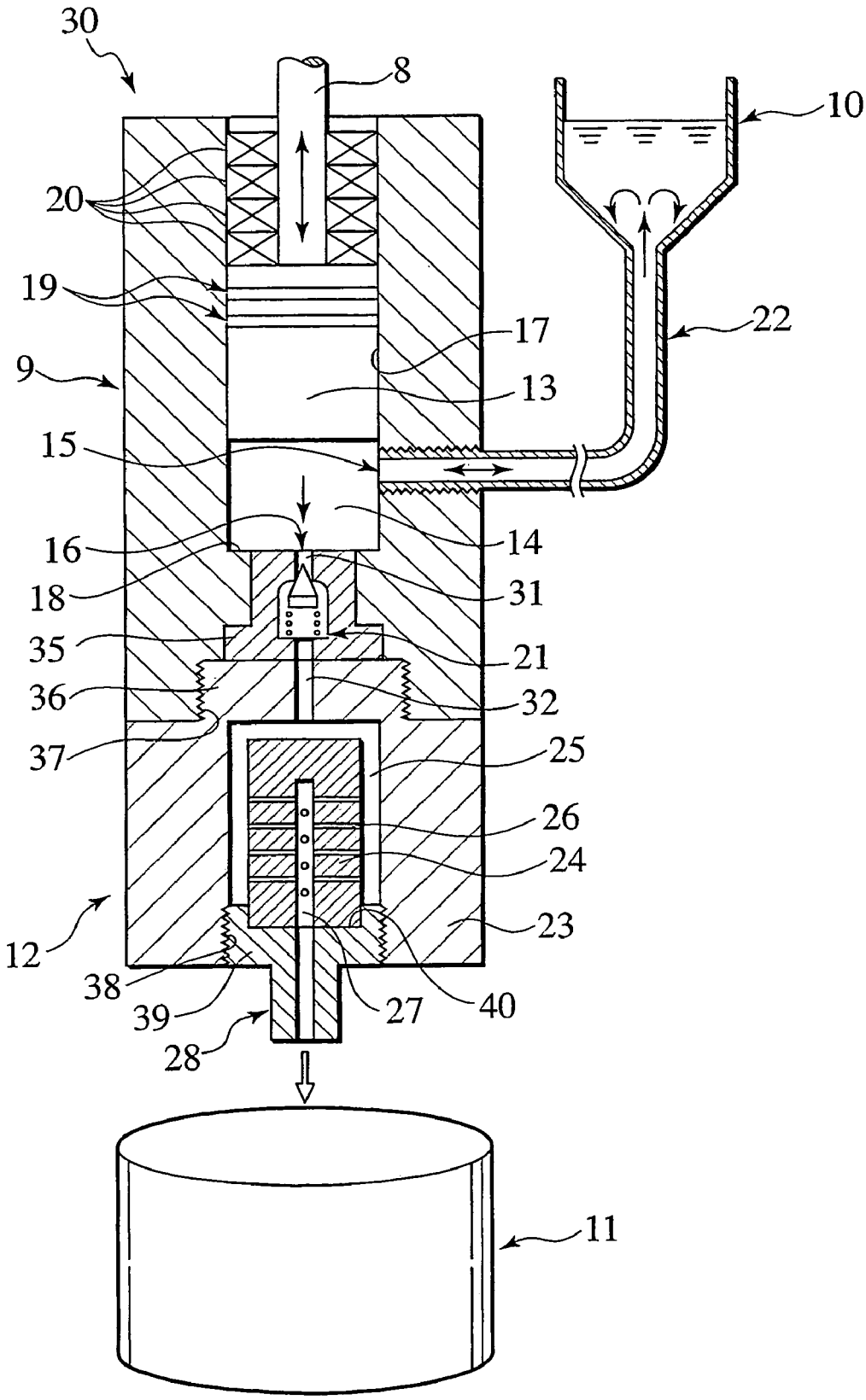
FIG. 2 is an enlarged partial cross-section diagram sectioned along II—II line in FIG. 1 when a piston is located on an upper dead center.
Figure 3:
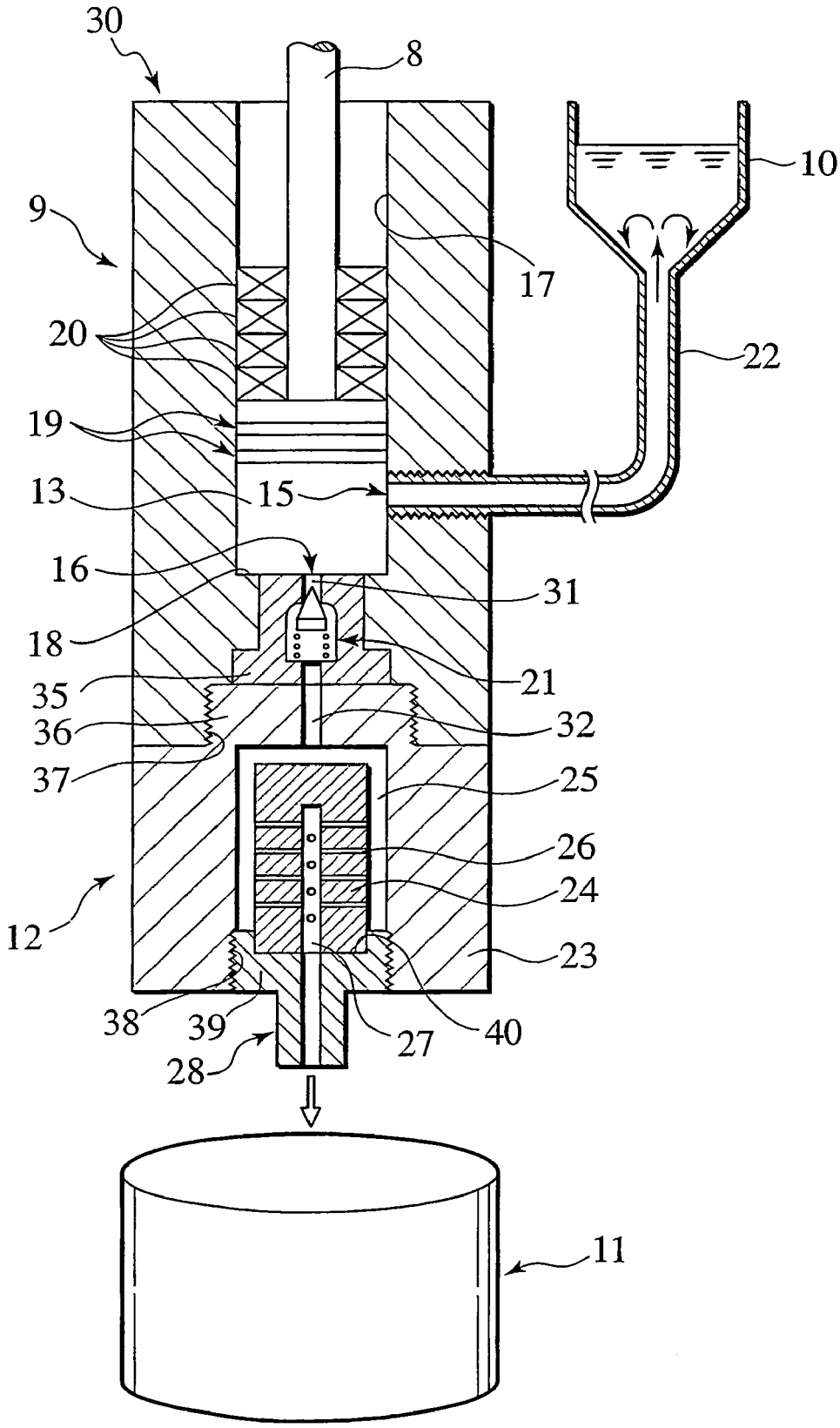
FIG. 3 is an enlarged partial cross-section diagram sectioned along II—II line in FIG. 1 when the piston is located on a bottom dead center.

As shown in FIGS. 2 and 3, the pump member 9 has the piston 13, a cylinder 17, the pipe 22 and a connecting portion 35. The cylinder 17 opens at one end thereof. The connecting portion 35 closes the other end of the cylinder 17. Here, it noted that the other end of the cylinder 17 is named a closed end 18. One end of piston 13 is integrally linked to the piston shaft 8 and reciprocally moves inside the cylinder 17 with a rotation of the crankshaft 2.

A closed pressure chamber 14 is formed between the other end of the piston 13 and the closed end 18 of the cylinder 17. The piston 13 is provided with two pieces of piston packing 19. The piston shaft 8 is provided with four pieces of piston shaft packing 20. The piston packing 19 and the piston shaft packing 20 sliding with the piston 13 inside the cylinder 17 closes the pressure chamber 14.

The connecting portion 35 is fitted into the other end of the cylinder 17. The connecting portion 35 has a communicating hole 31 at a center portion thereof. The communicating hole 31 opens to the closed end 18 of the pressure chamber 14 at one end (an outlet 16) thereof. The communicating hole 31 opens to one end of a communicating hole 32 which is formed into an outer case 23 of the generator member 12 at the other end thereof. The communicating hole 31 is provided with a check valve 21. The check valve 21 opens and then sends the pressured raw material fluid into the generator member 12 when the piston 13 descends. The check valve 21 closes and then prevents the raw material fluid sent into the generator member 12 from flowing back when the piston 13 ascends.

The pipe 22 is connected to a side face of the cylinder 17 in order to link the pump member 9 with the charge vessel 10 therethrough. The pipe 22 opens to an inner surface of the cylinder 17 at one end (an intake 15) thereof. The pipe 22 opens to a bottom surface of the charge vessel 10 at the other end thereof. The pipe 22 and the cylinder 17 are connected together by screwing a male screw portion threaded on a side surface of the pipe 22 into a female screw portion threaded on the side surface of the cylinder 17.

A reciprocating stroke of the piston 13 will be described. As shown in FIG. 2, in a case where the piston 13 ascends from a bottom dead center (a charging stroke), the check valve 21 closes and then prevents the raw material fluid sent into the generator member 12 from flowing back. The raw material fluid in the charge vessel 10 is delivered into the pressure chamber 14 through the pipe 22 because the intake 15 opens with the ascent of the piston 13.

In a case where the piston 13 descends from an upper dead center (a discharge stroke), the raw material fluid of the pressure chamber 14 flows back into the charge vessel 10 through the pipe 22 in the first half of the discharge stroke because the intake 15 opens. In the last half of the discharge stroke, as shown in FIG. 3, the raw material fluid pressured in the pressure chamber 14 is sent from the outlet 16 into the generator member 12 because the intake 15 is closed by the side surface of the piston 13. At the bottom dead center of the piston 13, since the piston packing 19 and the piston shaft packing 20 locates above the intake 15, the packing is prevented from being damaged by flow pressure of the raw material fluid.

In a conventional pump, since a pipe through which a charge vessel is connected to a pump member is provided with a check valve for charge therein, a raw material fluid of a pressure chamber is prevented from flowing back into the charge vessel in a discharge stroke. On the other hand, in the present invention, since the intake 15 opens to the pressure chamber 14 until the intake 15 is closed by the side surface of the piston 13, that is to say, before the last half stroke, the raw material fluid of the pressure chamber 14 flows back into the charge vessel. Although this flow-back reduces packing efficiency of the pump member 9, the flow-back is small in amount because an inside diameter of the pipe 22 is small. Therefore, it slightly influences on the packing efficiency of the pump member 9. Further, it is not necessary to install an agitator in the charge vessel 10 because the flow-back agitates several raw materials among which specific gravity differs in the charge vessel 10. Additionally, in the last half of the discharge stroke, the raw material fluid of the pressure chamber 14 is certainly prevented from flowing back into the charge vessel 10 without depending to the raw material fluids' character because the intake 15 is closed by the side surface of the piston 13.

Also, it is possible to improve pump efficiency because average velocity of the piston 13 in upper and lower directions is changed by eccentrically connecting the connecting-rods 7*a*, 7*b*, 7*c* to the crankpin 6*a*, 6*b*, 6*c*, respectively.

Next, a configuration of the generator member 12 will be described in detail. As shown in FIGS. 2 and 3, the generator member 12 has the outer case 23, an inner case 24 and an outlet 28. A male thread portion 36 formed on a center of an upper end surface of the outer case 23 is screwed into a female thread portion 37 formed on a center of a bottom end surface of the pump member 9, and thereby the generator member 12 is connected to the pump member 9. Further, the communicating hole 32 is provided to a center portion of the male thread portion 36 of the outer case 23. The pressured raw material fluid is sent into a hollow chamber 25 by allowing the communicating hole 32 to open to the communicating hole 31 of the connecting portion 35 at one end thereof and to the hollow chamber 25 at the other end thereof. The ceramic hollow chamber 25 which closes at one end thereof and opens at the other end thereof is formed inside the outer case 23. A female thread portion 38 formed on the other end of the hollow chamber 25 is screwed to a male thread portion 39 of the outlet 28, and thereby the outer case 23 is connected to the outlet 28. Further, the hollow chamber 25 accommodates the inner case 24. A bottom end portion of the inner case 24 is inserted into a concave portion 40 formed on a center of an upper end surface of the male thread portion 39 and having the same diameter of the inner case 24, and thereby the inner case 24 is fixed to the outlet 28.

A center passage 27 is formed in the inner case 24 along an axial direction of the inner case 24. A plurality of hole portions 26 are formed in the side surface of the inner case 24 along a radial direction of the inner case 24. The hole portions 26 open to the hollow chamber 25 at one end thereof and to the center passage 27 at the other end thereof. The center passage 27 closes at one end thereof and opens to an outlet hole of the outlet 28 at the other end thereof.

For example, the inner case 24 is a cylindrical body having a diameter of 40 mm and a length of 40 mm. Each of the hole portions 26 has a diameter from 0.1 to 0.4 mm. On the side surface of the inner case 24, the inner case 24 consists of n hole portions 26 (n is form 2 to 8) in the radial direction thereof and m hole portions 26 (m is one or more) in the axial direction thereof. Since the inner case 21 is made of ceramic, the hole portions 26 are easily formed.

A substance included in the pressured raw material fluid is atomized according to a nozzle character of each hole portion 26. Total volume of the hole portions 26 is much smaller than piston stroke volume (for example, a piston diameter of 40 mm and a stroke length of 40 mm) of the pump member 9. Therefore, pressure applied to the raw material fluid in the hole portions 26 is higher than pressure applied to the raw material fluid in the pump member 9. Namely, the raw material fluid passes through the hole portions 26 at high-speed flow and then the substance included in the raw material fluid is atomized according to the nozzle character of each hole portion 26. The raw material fluids further crash each other at high-speed in the center passage 24 and then the substance included in the crashed raw material fluid is atomized. The atomized raw material (the raw material product) is discharged from the other end of the outlet hole of the outlet 25 into the discharge vessel 11.

In a case where a raw material is changed or a blockage in members occurs, it is necessary to from charge to discharge flush out all members which contact with the prior raw material fluid and then check them so as to realize prevention of contamination. However, flushing and checking works are easily performed because the atomizing apparatus 30 is simply decomposed into an outlet 28, the inner case 26, the outer case 23, the connecting portion 35, the check valve 21, the pipe 22, the cylinder 17 and the piston 13.

Figure 4:
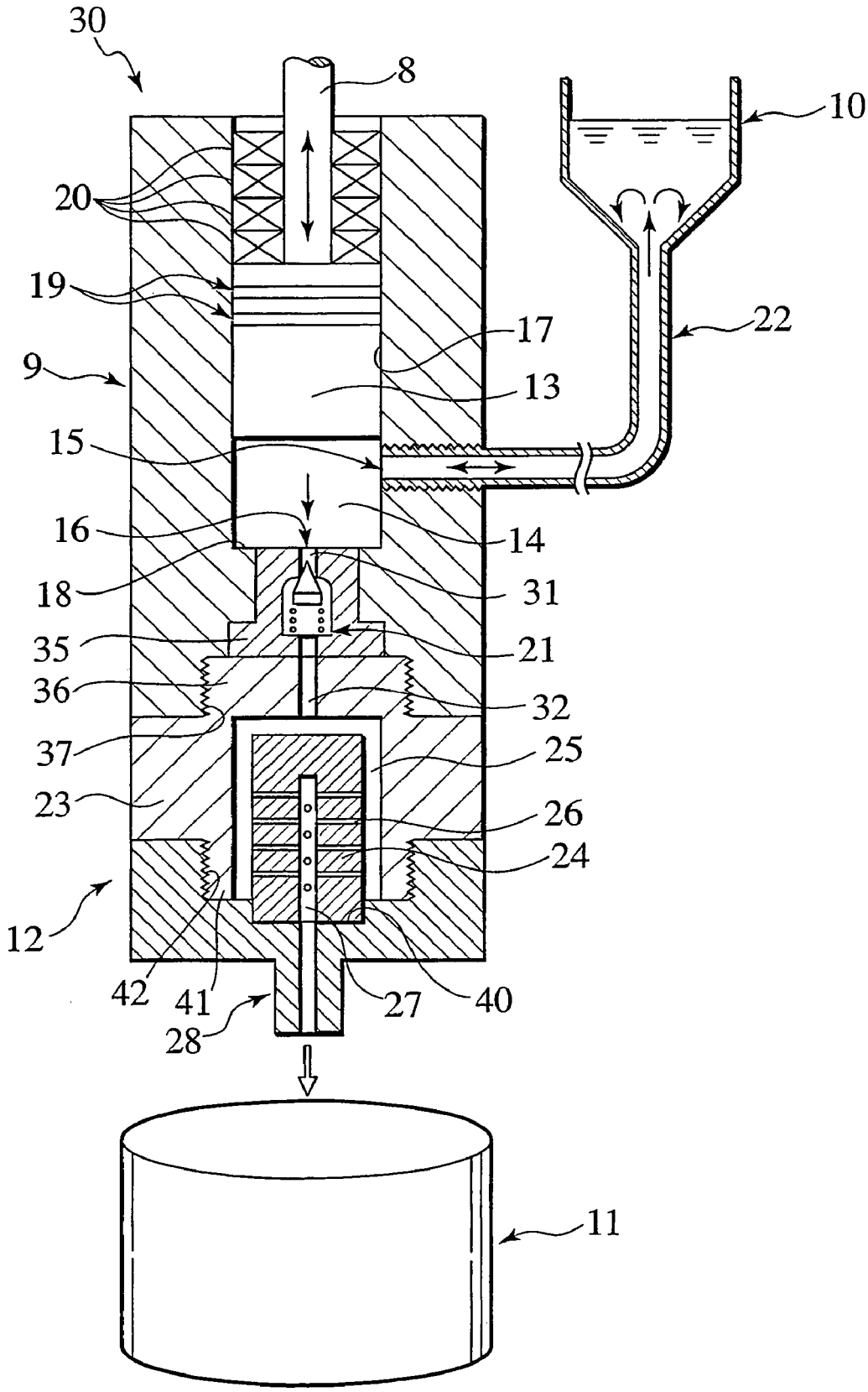
FIG. 4 is an enlarged partial cross-section diagram sectioned along II—II line in FIG. 1 in which the first modification of the present embodiment is shown.

As the first modification of the present embodiment, as shown in FIG. 4, the inner case 23 may be connected to the outlet 28 by screwing a male thread portion 41 formed on the center of the bottom end surface of the inner case 23 into a female thread portion 42 formed on the center of the upper end surface of the outlet 28. In this case, the hollow chamber 25 opens at an end center of the male thread portion 41, and thereby the hollow chamber 25 is certainly closed and the outlet 28 is easily detachable from the outer case 23.

Figure 5:
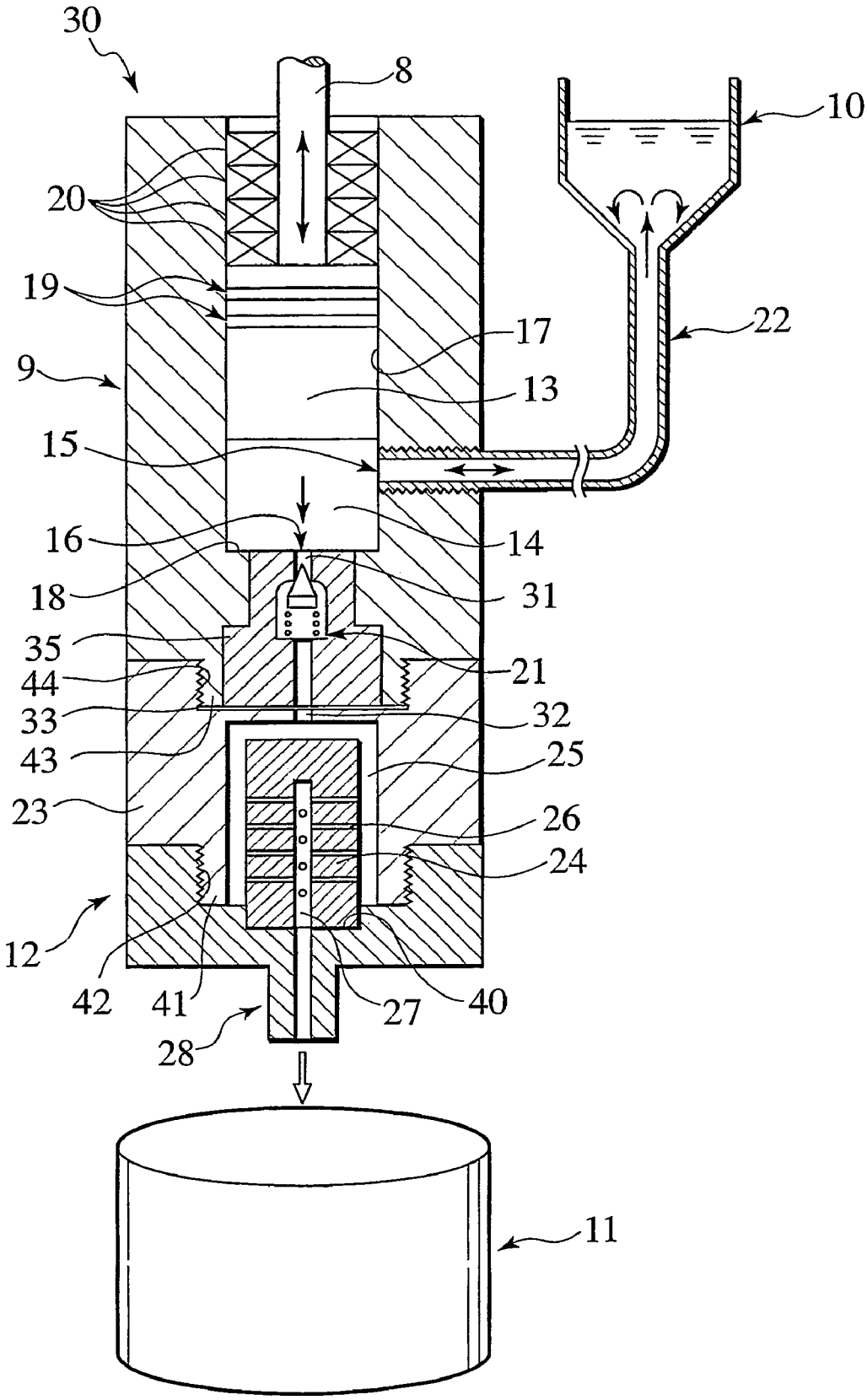
FIG. 5 is an enlarged partial cross-section diagram sectioned along II—II line in FIG. 1 in which the second modification of the present embodiment is shown.

As the second modification of the present embodiment, as shown in FIG. 5, the pump member 9 may be connected to the generator member 12 by screwing a male thread portion 43 formed on the center of the bottom end surface of the pump member 9 into a female thread portion 44 formed on the center of the upper end surface of the outer case 23, in addition to connecting the outer case 23 to the outlet 28 described in the first modification. In this case, one part of the connecting portion 35 is fitted to a center portion of the male thread portion 43 of the pump member 9, and the communicating hole 32 opens to a center of a bottom surface of the female thread portion 44 at one end thereof. Further, the female thread portion 44 of the outer case 23 is provided with packing 33 at a bottom surface thereof, and thereby a user can easily grasp the outer case 23 because the outer case 23 is longer than the outer case of the first modification along the an axial direction thereof.

Figure 6:
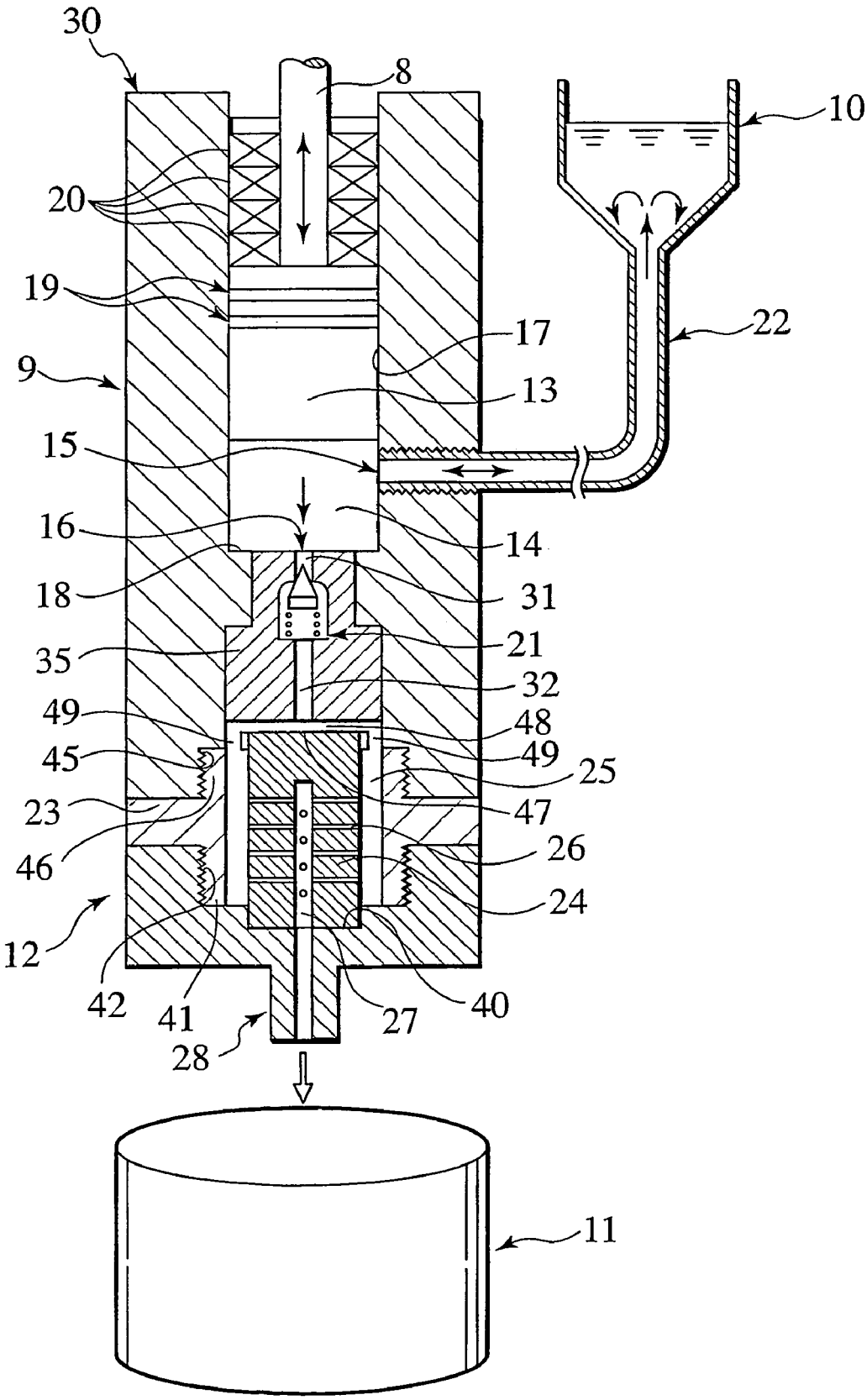
FIG. 6 is an enlarged partial cross-section diagram sectioned along II—II line in FIG. 1 in which the third modification of the present embodiment is shown.

As the third embodiment of the present embodiment, a connection of the pump member 9 and the generator member 12 may be employed as shown in FIG. 6, in addition to connecting the outer case 23 to the outlet 28 described in the first embodiment. A female thread portion 45 is formed on the center of the bottom end surface of the pump member 9. A concave portion 47 having the same diameter of the inner case 24 is formed on a center of a bottom surface of the female thread portion 45. A groove portion 48 is formed on a center of a bottom surface of the concave portion 47. Communicating holes 49 open to the hollow chamber 25 at one end thereof and to both ends of the groove portion 48 at the other end thereof. The communicating hole 31 of the connecting portion 35 opens to a center of a bottom surface of the groove portion 48 at the other end thereof. Thereby, the pressured raw material fluid is sent from the pressure chamber 14 into the hollow chamber 25 through the communicating hole 31, the groove 48 and the communicating holes 49.

The male thread portions 41, 46 is formed on both ends of the outer case 36 and the hollow chamber 25 opens to centers of end faces of the male thread portions 41, 46. The outer case 23 is connected to the pump member 9 by screwing the male thread portion 46 of the outer case 23 into the female thread portion 45 of the pump member 9. At this time, the hollow chamber 25 accommodates both end portions of the inner case 24 sandwiched between the concave portions 40, 47, and thereby the hollow chamber 25 certainly closes between the pump member 9 and the outlet 28.

As the fourth modification of the present embodiment, the cylinder 17 may be fixedly provided with packing in the pump member 9.

As the fifth modification of the preset embodiment, a power mechanism such as an electrohydraulic motor or a pneumatic motor and a manumotive mechanism may be employed as the motor rotating the crankshaft, and a drive mechanism controlled by an electrical operation may be employed as a crank mechanism including the crankshaft.

As the sixth modification of the present embodiment, in the atomizing process system 50, the atomizing apparatuses 30*a*, 30*b*, 30*c* may be disposed along a horizontal direction, and then the charge vessel 10 and the discharge vessel 11 may be disposed above and below the atomizing apparatuses 30*a*, 30*b*, 30*c*, respectively.

INDUSTRIAL APPLICABILITY

An atomizing apparatus of the present invention allows a raw material fluid to flow back from a pressure chamber into a charge vessel in the first half of a discharge stroke and not to flow back from the pressure chamber into the charge vessel in the last half of the discharge stroke. Also, the atomizing apparatus of the present invention allows a flushing work to be easily performed because a constructional element is simplified.

The invention claimed is:

1. A substance-atomizing apparatus comprising:

a pump member having:

a cylinder opening at one end thereof and closing at the other end thereof;

a pipe through which a raw material fluid is introduced from a charge vessel into the cylinder; and a piston reciprocally moved by a drive device in the cylinder to pressurize the raw material fluid in the cylinder; and a generator member inserting the raw material fluid pressurized in the pump member into a hole portion formed therein to atomize a substance included in the raw material fluid according to a nozzle character of the hole portion, wherein a pressure chamber is formed between the piston and a closed end of the cylinder, an intake to which the pipe opens at one end thereof is formed on a cylinder side surface of the pressure chamber, an outlet is formed on the closed end of the cylinder, the outlet is closed and the raw material fluid is received from the charge vessel into the pressure chamber through the intake in a first stroke of the piston, the raw material fluid is sent from the pressure chamber into the charge vessel through the intake in the first half of a second stroke of the piston, the intake is directly closed by a side surface of the piston and the raw material fluid is sent from the pressure chamber into the generator member through the outlet in the last half of the second stroke of the piston.

2. The substance-atomizing apparatus according to claim 1, wherein the pump member has a check valve for opening and closing the outlet.

3. The substance-atomizing apparatus according to claim 1, wherein the generator member has an outlet portion having an outlet hole for sending to a discharge vessel the raw material fluid including the atomized substance therein.

4. The substance-atomizing apparatus according to claim 3, wherein the generator member has;

an outer case connected to the cylinder at one end thereof and to the outlet portion at the other end thereof; and an inner case accommodated by the outer case and fixed to the outlet portion at one end thereof, a hollow chamber is formed between the outer case and the inner case, a communicating hole for communicating the pressure chamber with the hollow chamber through the outlet is formed at one end the outer case, a center passage which closes at one end thereof and opens to the hollow chamber at the other end thereof is formed in the inner case, a plurality of the hole portions which each opens to the center passage at one end thereof and to the hollow chamber at the other end thereof are formed on a side surface of the inner case.

5. The substance-atomizing apparatus according to claim 4, wherein the inner case is made of a ceramic.

6. The substance-atomizing apparatus according to claim 4, wherein the inner case is fixed to a concave portion formed on an end face of the outlet portion, at one end thereof.

7. The substance-atomizing apparatus according to claim 4, wherein the inner case is fixed to a first concave portion formed on an end face of the outlet portion, at one end thereof and to a second concave portion formed on an end face of the cylinder, at the other end thereof.

8. The substance-atomizing apparatus according to claim 4, wherein the outer case is connected to the cylinder by screwing a male thread portion threaded on one end of the outer case into a female thread portion threaded on the cylinder.

9. The substance-atomizing apparatus according to claim 4, wherein the outer case is connected to the cylinder by screwing a male thread portion threaded on the cylinder into a female thread portion threaded on one end of the outer case.

10. The substance-atomizing apparatus according to claim 4, wherein the outer case is connected to the outlet portion by screwing a male thread portion threaded on the outlet portion into a female thread portion threaded on the other end of the outer case.

11. The substance-atomizing apparatus according to claim 4, wherein the outer case is connected to the outlet portion by screwing a male thread portion threaded on the other end of the outer case into a female thread portion threaded on the outlet portion.

* * * * *